United States Patent [19]

Genoni

[11] Patent Number: 4,602,440

[45] Date of Patent: Jul. 29, 1986

[54] DRYING APPARATUS FOR COATING OR CANDYING MACHINES

[75] Inventor: Nunzio G. Genoni, Busto Arsizio, Italy

[73] Assignee: G.S. Di Scipioni e Giogoli S.N.C., Osteria Grande, Italy

[21] Appl. No.: 688,426

[22] Filed: Jan. 2, 1985

[51] Int. Cl.[4] ..... F26B 11/04

[52] U.S. Cl. ..... 34/134; 34/140

[58] Field of Search ..... 34/134, 138, 130, 140

[56] References Cited

U.S. PATENT DOCUMENTS 3,874,092 4/1975 Huttlin ..... 34/134

FOREIGN PATENT DOCUMENTS 2423933 11/1975 Fed. Rep. of Germany .
2731351 4/1978 Fed. Rep. of Germany .
2222957 10/1974 France .
2278316 2/1976 France .
2374968 7/1978 France .
1008664 11/1965 United Kingdom .

*Primary Examiner*—Larry I. Schwartz
*Attorney, Agent, or Firm*—Young & Thompson

[57] ABSTRACT

Apparatus for drying particles in an air flow, the air inlet of which opens freely into a rotating drum. Air is removed from the particles through one or more perforated hollow bodies immersed in the mass of rotating particles, as near as possible to the external periphery of the drum. Preferably, the hollow bodies are two in number and are arranged on either side of blades provided on the rotating drum. Each hollow body is of elliptical shape in cross section. Preferably, it is also provided to adjust the angular position of the hollow body or bodies relative to a vertical plane through the drum axis.

6 Claims, 3 Drawing Figures

DRYING APPARATUS FOR COATING OR CANDYING MACHINES

This invention relates to a drying apparatus for coating, candying or similar machines capable of carrying out any coating of cores of different type and shape, normally comprising a rotating drum having inserted therein such loose particles as tablets, lozenges, granules or the like, which are coated by a solution or suspension which is sprayed on such particles, while a stream of hot air circulates in said drum for drying said solution or the like.

Herein, the term "candying" is meant as any coating process of loose cores.

Different types of drums and different drying apparatuses are already known. Some provide air ingress freely on the surface of the moving mass of particles, while others provide instead such air ingress through shaped hollow bodies which penetrate into the mass of the moving particles. The first of these systems has the disadvantage of requiring very long candying periods, while at times it gives rise to powder that grows bigger and bigger in the course of the candying operation, thus forming in the drum an undesirable granulous residue. On the other hand, the second system has the disadvantage of requiring a high consumption of energy for ventilation. Furthermore, in this case, the drum remains always at a lower temperature than that of the mass of particles to be candied.

Another known type of drum provides air ingress into the drum chamber from the drum periphery which has perforated areas. However, this system has the disadvantage of being unsuitable to ensure that cleaning operations carried out at the end of work would lead to a complete removal of the residues, since the perforations in the drum walls prevent an easy and efficient cleaning.

Therefore, it is the object of the present invention to provide a drying apparatus for coating or candying machine drums enabling a fast candying process free of powder formation and at the same time allowing an easy cleaning of the drum.

It is another object of the invention to provide an extremely versatile type of drying apparatus, combining the advantages of all systems hitherto known.

The above object has been achieved by providing that air inlet should freely occur within the chamber enclosed by the rotating drum, while air removal occurs through perforated hollow bodies immersed in the mass of the moving particles.

Preferably, the hollow bodies are two in number and are arranged on either side of the blades, the latter being normally provided centrally of the rotating drum interior.

Moreover, removal preferably takes place as near as possible to the drum periphery, that is said perforated hollow body or bodies are positioned extremely close to the periphery of said drum. As seen in cross-section, the hollow body is preferably of elliptical shape.

It is also provided to adjust the angular position of the sucking hollow body or bodies relative to a vertical plane passing through the drum axis, by rotating the support thereof which has been set with its own axis preferably coincident with the drum axis. Preferably, this rotation can move the hollow body outside of the mass of the moving particles.

It is another preferred solution to provide the hollow body as disassemblable, so as to enable an easy removal of the hollow bodies and relevant cleaning. Particularly, it is provided to disassemble each hollow body with its own sucking or conveyor tube length.

The invention will be further described with reference to an exemplary embodiment shown in the accompanying drawing, in which.

Figure 1:
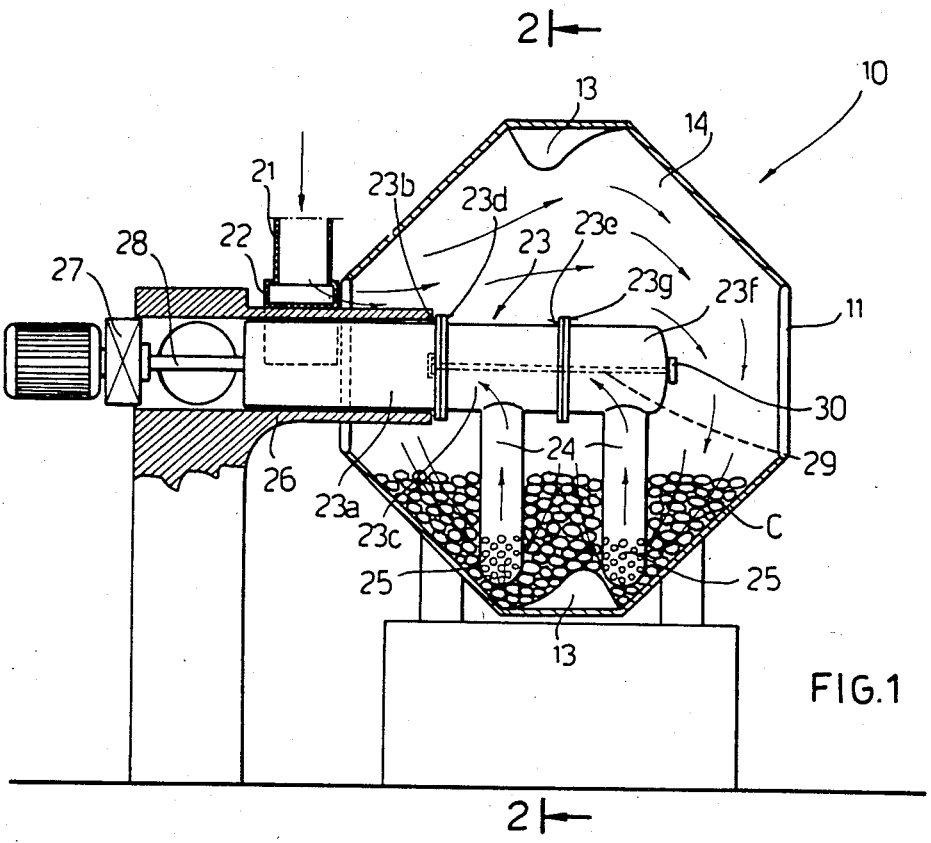
FIG. 1 is a side sectional view of a drum, in which the proposed drying apparatus is used, taken on line 1—1 of FIG. 2.

Referring to the drawing, it will be seen that reference numeral 10 denotes the rotating drum as a whole. Tablets, lozenges and in general particles are inserted therein, for example through the door 11. When the drum starts to rotate they will form a rolling mass C, the surface 12 of which is inclined (see FIG. 2).

The drum is further provided with blades 13.

The drying apparatus comprises an air inlet channel 21 which leads to a semicircular distributing crown 22, which freely admits air into the drum cavity 14.

Figure 3:
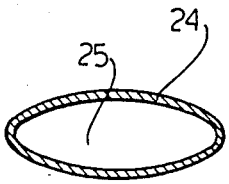
FIG. 3 is a sectional view taken along line 3—3 of FIG. 2.

Air removal or exhaust takes place through the air conveying tube 23 arranged along the axis of drum 10. It receives air from two tubes 24 penetrating into the mass of moving particles C. Said tubes 24 terminate at their end very close to the drum periphery with a perforated hollow portion 25 of elongate elliptical shape in cross-section (see FIG. 3). The walls of said hollow body 25 are provided with small holes through which the air is sucked in.

The air conveying tube 23 is axially arranged in the drum 10 and is rotatably mounted within the fixed bearing 26. The tube 23 is connected through a shaft 28 to a geared motor 27, so that it can rotate, moving the hollow body 25 to an inclined position thus forming an angle $\alpha$ relative to the vertical, which depends on the kind of particles being processed, on the speed of the drum and on their smoothness. Particularly, when required, said tubes 24 could be also displaced upward out of the mass of particles, so as not to interfere therewith.

It is also provided that said tubes 24 can be easily separated from the tube 23 so that they can be removed from the drum 10, in order that the latter may be easily and readily washed or flushed without suffering any obstruction from said hollow bodies. Moreover, said hollow bodies can thus be also separately washed to ensure complete elimination of residues. Particularly, the tube 23 may comprise a first tube length **23*a* having a flanged coupling 23*b*, to which a second length 23*c* having flanged couplings 23*d* and 23*e* is connected, to which a third closed length 23*f* with couplings 23*g* is then secured. The lengths 23*c* and 23*f* are each integral with one of said sucking tubes 24. A tie rod 29 with a knob 30 fixes together the whole sucking system comprising said conveyor 23**.

Figure 2:
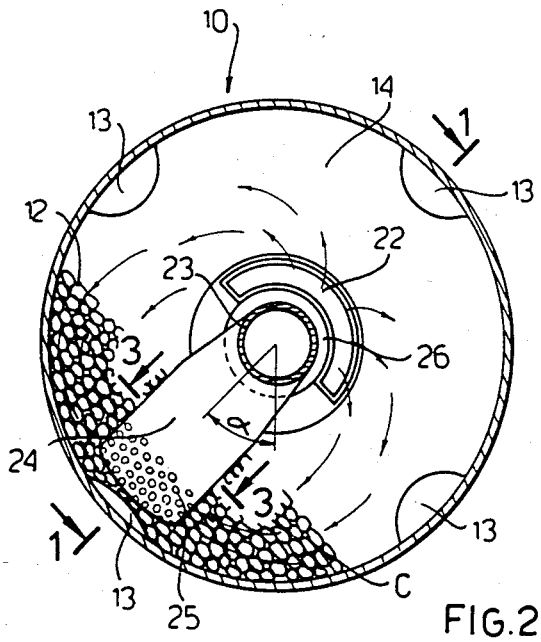
FIG. 2 is a sectional view taken along line 2—2 of FIG. 1.

The air flow has been shown by the arrows in FIGS. 1 and 2. The air enters from the inlet channel 21, arrives at the distributing crown 22 and then flows inside the cavity 14 of the drum 10. Now, the air is compelled to penetrate into the mass C of particles to be coated to reach the hollow bodies 25, and then the tubes 24 and 23.

What I claim is:

1. In a drying apparatus for drying a mass of particles, comprising a drum rotatable about a horizontal axis, at least one perforated hollow body immersed in the particles, and conduit means for withdrawing air from said at least one perforated hollow body and for conveying the withdrawn air out of the drum in a direction parallel to the axis of the drum, the improvement comprising means for discharging air into the interior of the drum outside said conduit means and above the surface of said mass of particles whereby air moves from said introducing means through a free space within the drum that is downwardly bounded by the surface of the mass of particles and thence through the surface of the mass of particles and thence to said at least one perforated hollow body.

2. Apparatus as claimed in claim 1, said at least one hollow body extending closely adjacent the periphery of the drum.

3. Apparatus as claimed in claim 1, said at least one hollow body being elliptical in cross section.

4. Apparatus as claimed in claim 1, the position of said at least one hollow body being adjustable with respect to a vertical plane passing through the axis of the drum.

5. Apparatus as claimed in claim 4, in which said at least one hollow body is connected to an air outlet duct whose axis coincides with the drum axis, said outlet duct being mounted for rotation about said axis thereby to vary the position of the hollow body relative to the mass of particles.

6. Apparatus as claimed in claim 1, said means for discharging air into the drum comprising an air inlet channel that leads to an arcuate distributing crown that extends about said conduit means and empties into said free space at one axial end of the drum.

* * * * *